US009843126B1

(12) United States Patent
Irish

(10) Patent No.: US 9,843,126 B1
(45) Date of Patent: Dec. 12, 2017

(54) CONNECTOR HOUSING ASSEMBLIES WITH ACCESS HOOD AND PUSH SURFACE

(71) Applicant: Sumitomo Wiring Systems, Ltd., Yokkaichi, Mie (JP)

(72) Inventor: Danielle Irish, Farmington Hills, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/437,981

(22) Filed: Feb. 21, 2017

(51) Int. Cl.
*H01R 13/518* (2006.01)
*H01R 43/26* (2006.01)
*H01R 13/631* (2006.01)

(52) U.S. Cl.
CPC ..... *H01R 13/518* (2013.01); *H01R 13/631* (2013.01); *H01R 43/26* (2013.01)

(58) Field of Classification Search
CPC ..... H01R 13/518; H01R 13/631; H01R 43/26
USPC ..... 439/374, 157
See application file for complete search history.

(56) References Cited

U.S. PATENT DOCUMENTS 5,575,676 A * 11/1996 Tsukakoshi ..... H01R 13/62911 439/157
5,637,009 A * 6/1997 Tsuji ..... H01R 13/639 439/347
5,876,226 A * 3/1999 Tsukakoshi ..... H01R 13/62927 439/157
6,241,542 B1 * 6/2001 Nishide ..... H01R 13/7032 439/188
6,244,880 B1 * 6/2001 Fukase ..... H01R 13/62911 439/157
6,254,407 B1 * 7/2001 Burns ..... H01R 13/62905 439/157
6,361,362 B1 * 3/2002 Kressmann ..... H01R 13/743 439/157
6,364,704 B1 * 4/2002 Godefroy ..... H01R 13/4365 439/589
6,375,504 B1 * 4/2002 Ito ..... H01R 13/447 439/596
6,382,992 B1 * 5/2002 Bouchan ..... H01R 13/62911 439/157

(Continued)

FOREIGN PATENT DOCUMENTS

JP 3235479 B2 12/2001
JP 5161348 B2 3/2013

(Continued)

*Primary Examiner* — Alexander Gilman
(74) *Attorney, Agent, or Firm* — Dinsmore & Shohl LLP

(57) ABSTRACT

Connector housing assemblies configured to maintain the TPA in a pre-stage condition during shipment and to facilitate the engagement of the female housing into the male housing are provided. The female housing includes a second slot for receiving a female TPA. The female housing includes a female TPA support disposed adjacent the second slot extending a predetermined distance above the female TPA so as to prevent the female TPA from being pushed into the second slot from a top down load. The male housing includes a hood configured to receive the female TPA support so as to allow the female housing to be seated within the male housing. A lip may be disposed on a proximal end of the female housing. The lip extends above a top surface of the female housing a sufficient length so as to accommodate the push of a finger or thumb.

14 Claims, 7 Drawing Sheets

(56) References Cited

U.S. PATENT DOCUMENTS 6,422,882 B1 * 7/2002 May ..... H01R 13/62905 439/157
6,641,423 B1 * 11/2003 Giro ..... H01R 13/62977 439/157
6,648,700 B1 * 11/2003 Greiner ..... H01R 13/64 439/382
6,824,406 B1 * 11/2004 Sharples ..... H01R 13/62977 439/157
7,179,102 B2 * 2/2007 Yamashita ..... H01R 13/514 439/157
7,431,596 B2 * 10/2008 Fukatsu ..... H01R 13/62916 439/157
7,497,706 B2 * 3/2009 Daudin ..... H01R 13/514 439/157
7,704,086 B2 * 4/2010 Gimbel ..... H01R 13/5202 439/157
7,744,390 B2 * 6/2010 Tyler ..... H01R 13/62938 439/157
7,914,327 B2 * 3/2011 Campbell ..... H01R 13/4365 439/595
8,231,401 B2 * 7/2012 Amano ..... H01R 13/6272 439/357
8,241,052 B2 * 8/2012 Mulot ..... H01R 13/639 439/299
8,297,993 B2 * 10/2012 Schmidt ..... H01R 13/62911 439/157
8,419,485 B2 * 4/2013 Stausser ..... H01R 13/4362 439/559
8,449,319 B2 * 5/2013 Fujii ..... H01R 13/641 439/489
8,992,240 B2 * 3/2015 Shiga ..... H01R 13/62 439/157
9,083,116 B2 * 7/2015 Oshita ..... H01R 13/62911
9,666,984 B2 * 5/2017 Wanschoor ..... H01R 13/62922
2002/0090849 A1 * 7/2002 Shuey ..... H01R 13/62911 439/157
2004/0121640 A1 * 6/2004 Okamoto ..... H01R 13/62911 439/347
2009/0317993 A1 * 12/2009 Komiyama ..... H01R 13/5208 439/157

FOREIGN PATENT DOCUMENTS

JP 05172051 B1 3/2013
JP 5195661 B2 5/2013

* cited by examiner

CONNECTOR HOUSING ASSEMBLIES WITH ACCESS HOOD AND PUSH SURFACE

TECHNICAL FIELD

The present specification generally relates to connector housing assemblies configured to maintain a TPA in a pre-stage condition during shipping and facilitate the engagement of a male housing with a female housing.

BACKGROUND

Connector housing assemblies include a male housing for housing male electric connectors and a female housing for housing female electric connectors. The female electric connectors are configured to receive the male connectors.

Currently, the connector housing assemblies are shipped to the assembly worker in two packages. One of the packages contains a plurality of male housings and the other package contains a plurality of female housings. The assembly worker installs the male and female electric connectors in respective male and female housings and then joins the male and female housing together to complete the connector housing.

The male and female housing includes a Terminal Positioning Assurance (TPA). The TPAs include a plurality of through holes and guiding ribs which position the male and female connectors so as to ensure a proper electric connection between the male and female electric connectors.

The TPAs are configured to be seated in corresponding slots of the male and female housing. In particular, the TPAs are configured to engage the respective male and female housing in a pre-stage condition and a locked condition. This allows the TPAs to be secured to respective male and female housings during shipment and facilitates the introduction of respective male and female electric connectors. Once the male and female electric connectors are introduced into the male and female housing respectively, the TPAs are pushed into the locked condition so as to position the male and female electric connectors in a condition for a proper electric connection when the female housing is inserted into the male housing.

A prior art connector housing assembly 200 is provided in FIG. 1. FIG. 1 illustrates how the current female housing 202 has a generally planar top surface 202*a*, accordingly, the TPA extends beyond the top surface of the female housing when in the pre-stage condition. As such, the TPA may inadvertently get pushed into the locked condition during shipment, which requires the installer to position the TPA into the pre-stage condition in order to insert the female electric connector.

Further, the installation of the female housing into the male housing requires overcoming a certain amount of resistance, as the male and female housing are configured to engage each other in a tight-fit engagement. As there are electric wires protruding from the ends, the installer must grip the top and bottom surface of the female housing. This may cause fatigue.

Accordingly, it remains desirable to have a connector housing assembly wherein the TPA configured to maintain the TPA in a pre-stage condition during shipment. It further remains desirable to have a connector housing assembly wherein the female housing includes a surface configured to facilitate the engagement of the female housing into the male housing.

SUMMARY

In one embodiment, a connector housing assembly includes a male housing and a female housing. The male housing is configured to house a male electric connector. The male housing including a first slot for receiving a male TPA. The female housing houses a female electric connector. The female housing includes a second slot for receiving a female TPA. The male housing is configured to receive the female housing so as to connect the male electric connector with the female electric connector.

The female housing includes a female TPA support disposed adjacent the second slot. The female TPA support extends a predetermined distance above the female TPA so as to prevent the female TPA from being pushed into the second slot from a top down load. The male housing further includes a hood defining a female TPA passage configured to receive the female TPA support so as to allow the female housing to be seated within the male housing. The hood extends along an axis so as to allow the female TPA to slide into the male housing.

In one embodiment, the female housing includes a pair of female TPA supports. Each of the female TPA supports is disposed on opposite sides of the female housing and are adjacent the second slot. In such an embodiment, the female TPA supports may be disposed on either side of the second slot. Further in such an embodiment, the male housing includes a pair of hoods. Each of the pair of hoods is disposed on opposite sides of the male housing. Each of the pair of hoods extends along an axis so as to define a pair of female TPA passages spaced apart from each other and generally parallel to each other.

In one embodiment, the connector housing assemblies further includes a lip disposed on a proximal end of the female housing. The lip extends above a top surface of the female housing a sufficient length so as to accommodate the push of a finger or thumb. The lip may include a generally planar surface to accommodate the push of the finger or thumb. In one embodiment, the female housing further includes a lip support. The lip support is mounted to the top surface and the lip so as to support a front load applied to the lip and help maintain the lip in a generally orthogonal plane relative to the top surface of the female housing.

Accordingly, the connector housing assembly is configured to maintain the TPA in a pre-stage condition during shipment by having the female TPA support prevent the female TPA from being pushed into the locked condition as a result of a top down load on the female TPA. Further, the connector housing assembly includes a lip on the female housing so as to provide a surface configured to facilitate the engagement of the female housing into the male housing by providing a surface for a thumb or finger to press the female housing into the male housing.

BRIEF DESCRIPTION OF THE DRAWINGS

The embodiments set forth in the drawings are illustrative and exemplary in nature and not intended to limit the subject matter defined by the claims. The following description of the illustrative embodiments can be understood when read in conjunction with the following drawings, where like structure is indicated with like reference numerals and in which:

DETAILED DESCRIPTION

Referring generally to the figures, embodiments of the present disclosure include connector housing assemblies configured to maintain the TPA in a pre-stage condition during shipment and configured to facilitate the engagement of the female housing into the male housing by providing a surface for a thumb or finger to press the female housing into the male housing.

The connector housing assemblies include a male housing and a female housing. The male housing is configured to house a male electric connector. The male housing including a first slot for receiving a male TPA. The female housing houses a female electric connector. The female housing includes a second slot for receiving a female TPA. The male housing is configured to receive the female housing so as to connect the male electric connector with the female electric connector.

The female housing includes a female TPA support disposed adjacent the second slot. The female TPA support extends a predetermined distance above the female TPA so as to prevent the female TPA from being pushed into the second slot from a top down load. The male housing further includes a hood defining a female TPA passage configured to receive the female TPA support so as to allow the female housing to be seated within the male housing. The hood extends along an axis so as to allow the female TPA to slide into the male housing.

The connector housing assemblies may further a lip disposed on a proximal end of the female housing. The lip extends above a top surface of the female housing a sufficient length so as to accommodate the push of a finger or thumb. The lip may include a generally planar surface to accommodate the push of the finger or thumb. In one embodiment, the female housing further includes a lip support. The lip support is mounted to the top surface and the lip so as to support a front load applied to the lip and help maintain the lip in a generally orthogonal plane relative to the top surface of the female housing.

Accordingly, the connector housing assembly is configured to keep the female TPA in a pre-stage condition so as to facilitate the installation of female electric connectors. Further the lip provides a surface for pushing the female housing into the male housing so as to eliminate the need to grip and push the female housing into the male housing.

As used herein the terms proximal and distal are made in reference to the orientation of the related part when the connector housing assembly is assembled, wherein distal refers to the portion of the part facing the other during assembly and proximal refers to the portion of the part facing away from the part to be assembled with. The terms top and down refer to the orientation of the part as shown in the figures.

Figure 1:
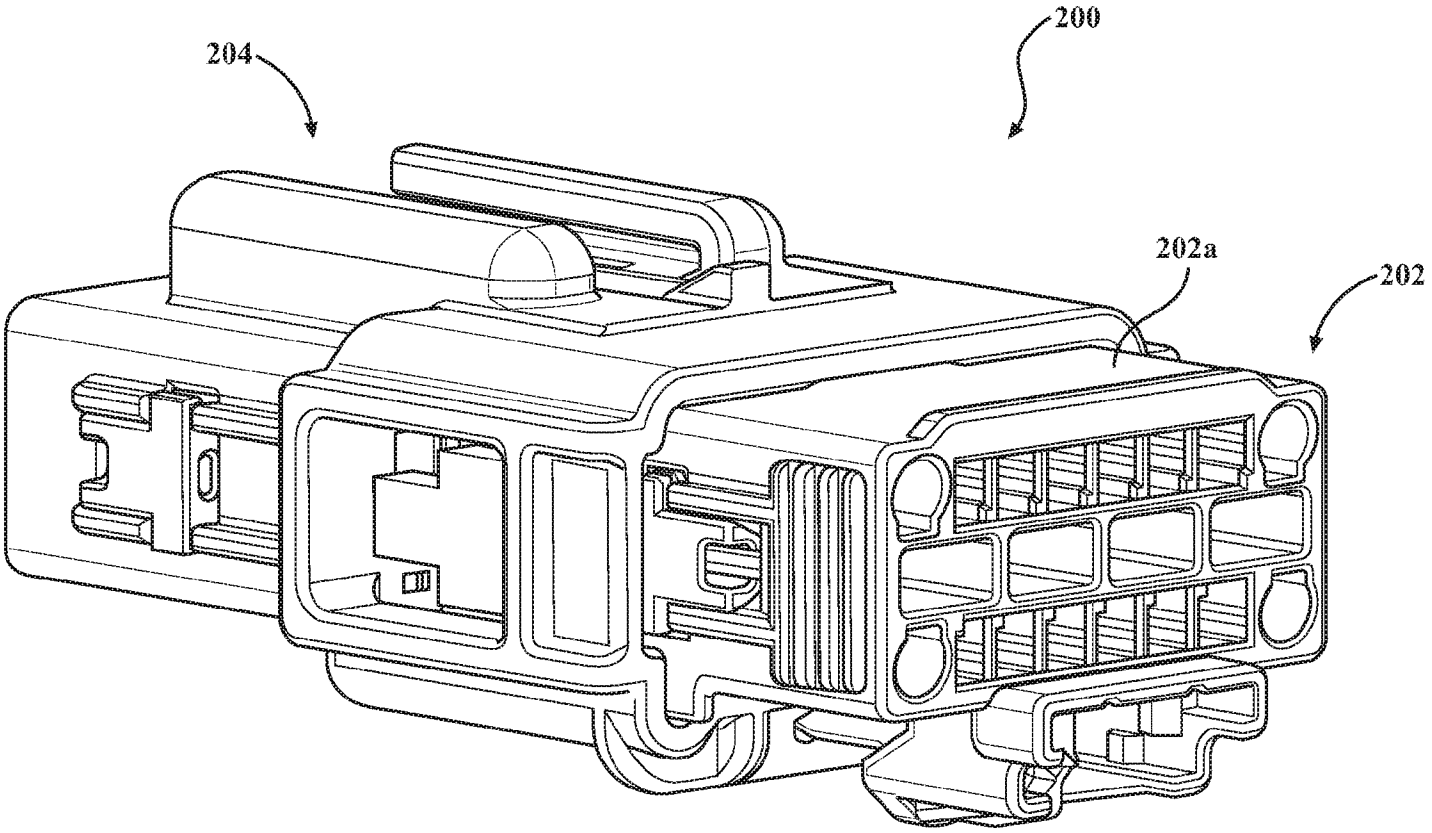
FIG. 1 PRIOR ART
FIG. 1 schematically depicts an embodiment of a prior art connector housing assembly.
Figure 2:
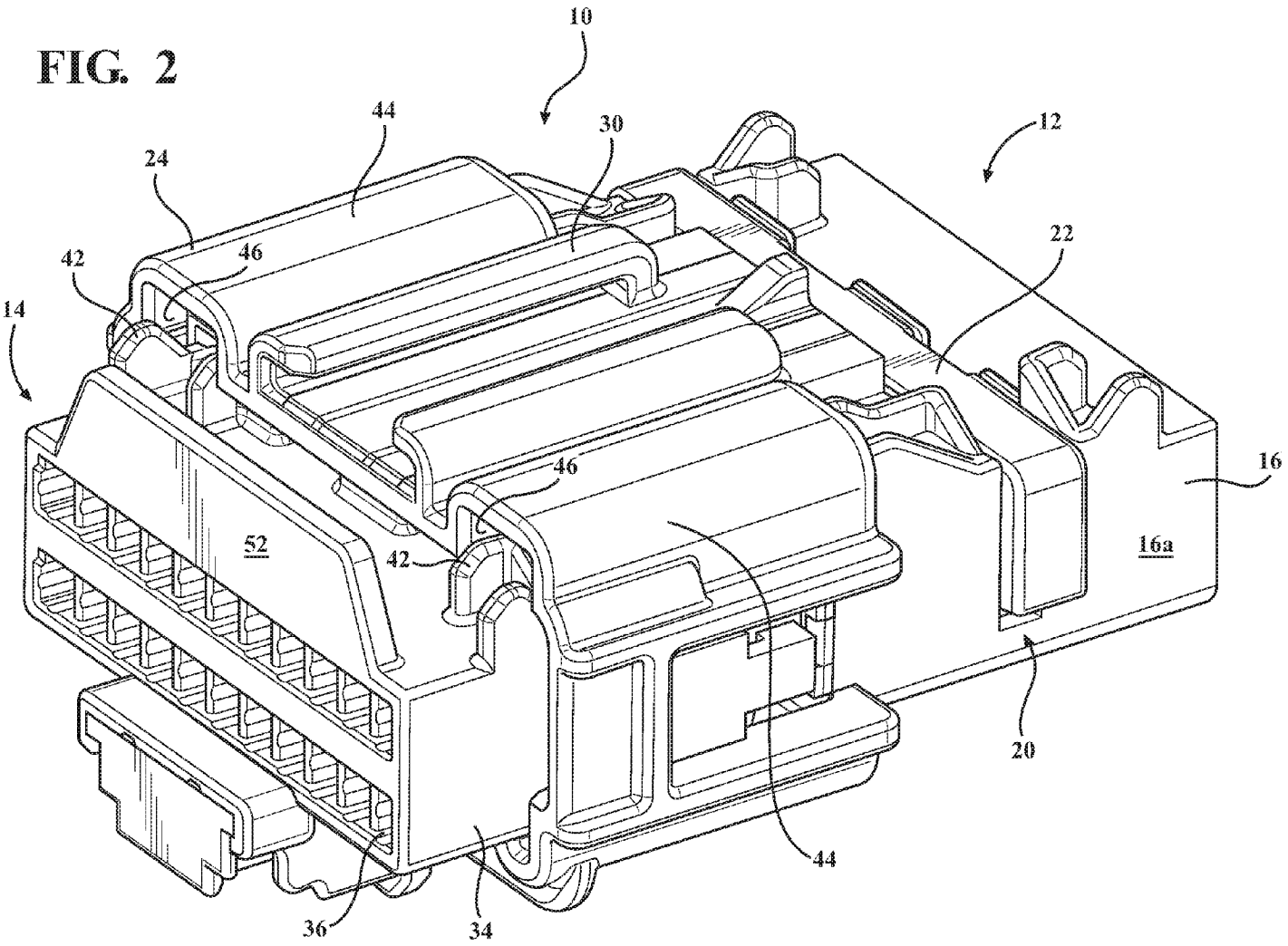
FIG. 2 schematically depicts a connector housing assembly according to one or more embodiments described and illustrated herein.
Figure 3:
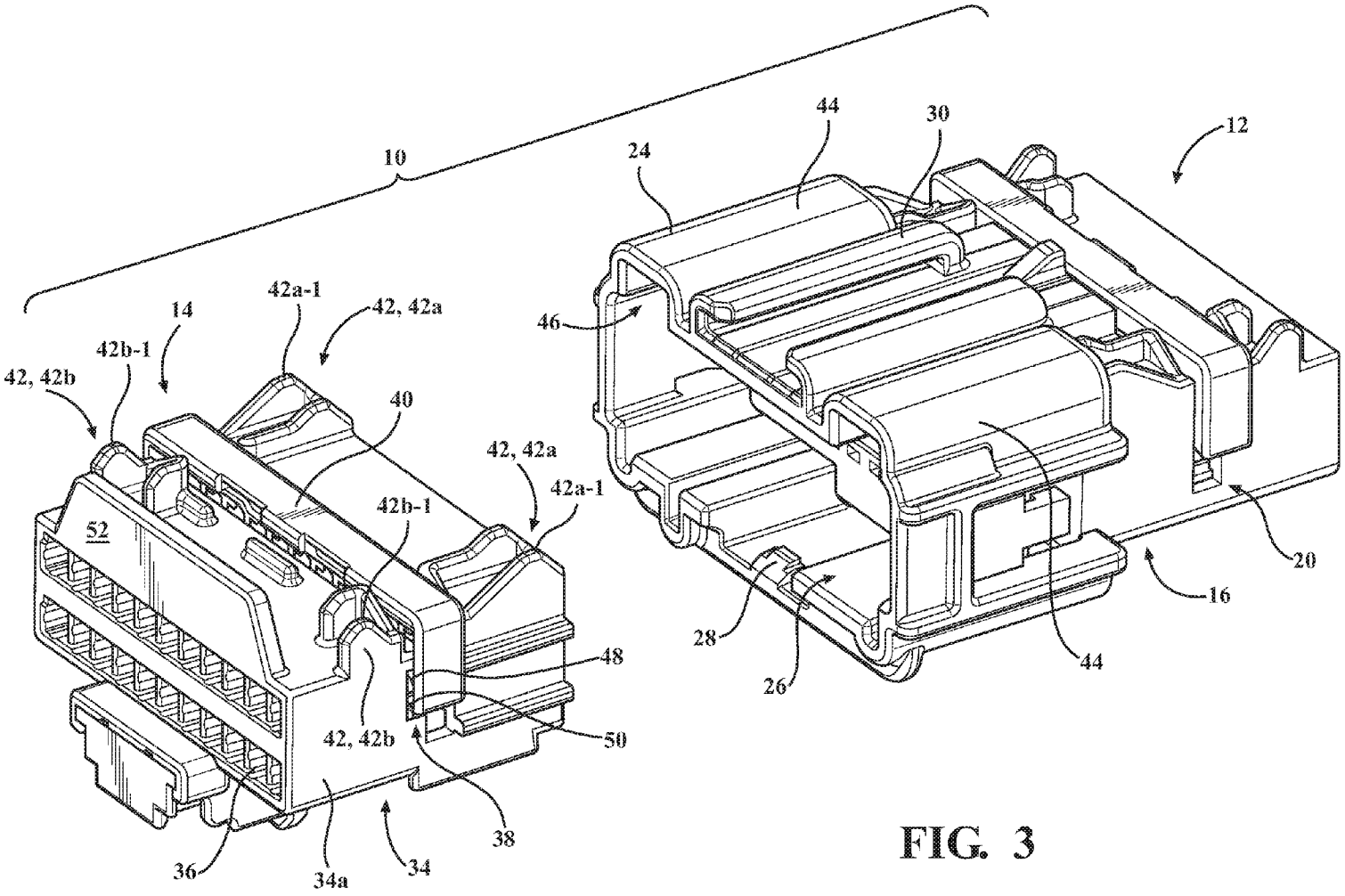
FIG. 3 schematically depicts the female housing disengaged from the male housing.

With reference now to FIGS. 2 and 3 an embodiment of the connector housing assembly 10 is provided. The connector housing assembly 10 includes a male housing 12 and a female housing 14. FIG. 2 shows the female housing 14 seated within the male housing 12. The male housing 12 and the female housing 14 may be formed of a material suitable for injection molding, such as polypropylene. The male housing 12 is configured to house a male electric connector (not shown). The female housing 12 is configured to house a female electric connector (not shown). The female electric connector includes a female blade (not shown) configured to receive a male blade (not shown) of the male electric connector so as to complete an electric connection. Accordingly, it should be appreciated that the male blades must be aligned to respective female blades when the male and female housing 12, 14 are coupled together. The ends of the male and female electric connectors include wires (not shown) which would extend from the back ends of the respective.

Figure 7:
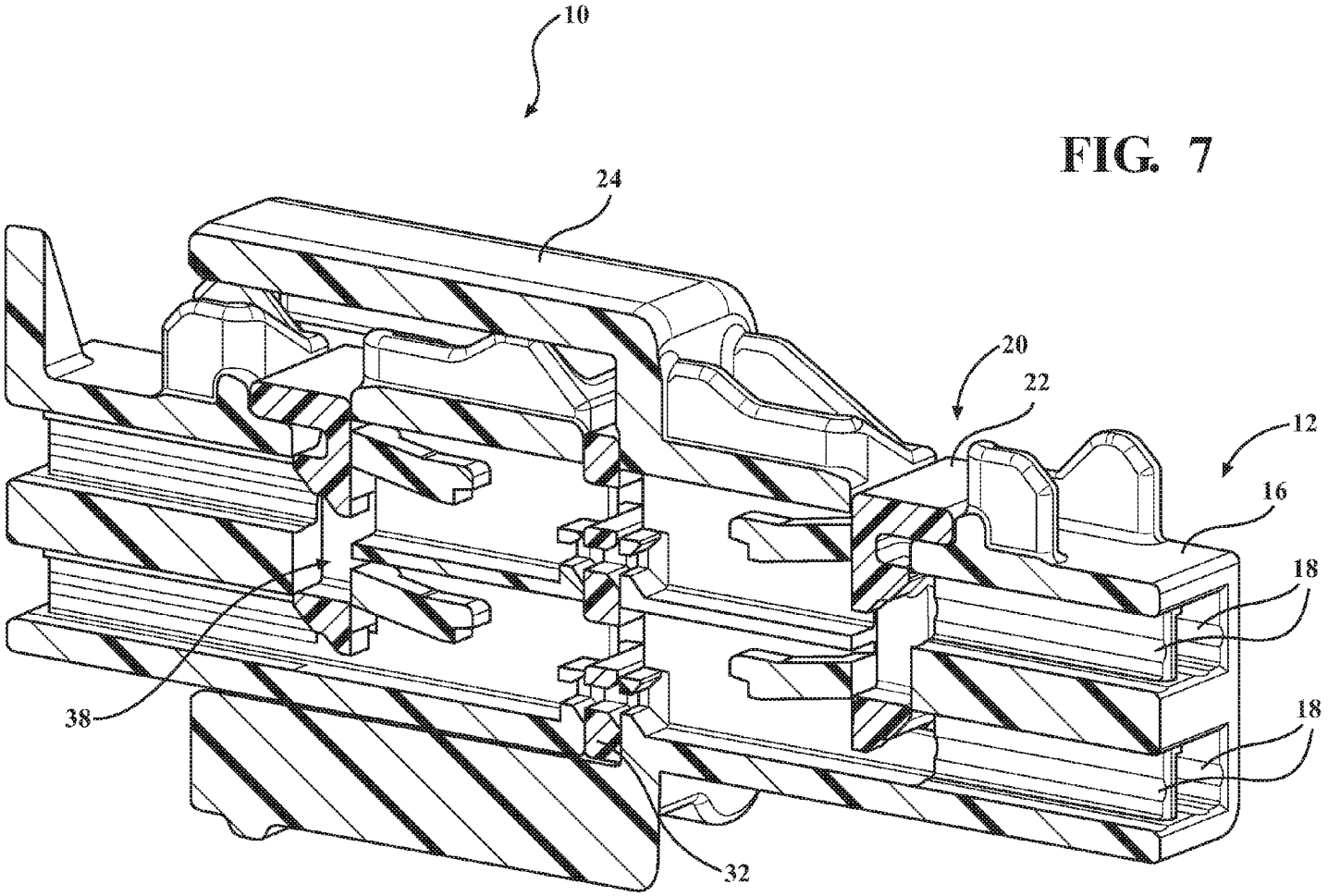
FIG. 7 is a cross sectional view of FIG. 2 taken along line 7-7.

With reference also to FIG. 7, the male housing 12 has a first body 16 having a plurality of first through-bores 18. The first body 16 is shown as being generally cuboid, but the first body 16 may take other shapes based upon packaging constraints. The first through-bores 18 are configured to receive a male electric connector. The male housing 12 further includes a first slot 20 for receiving a male TPA 22. The first slot 20 extends across the width of the first body 16.

Figure 5:
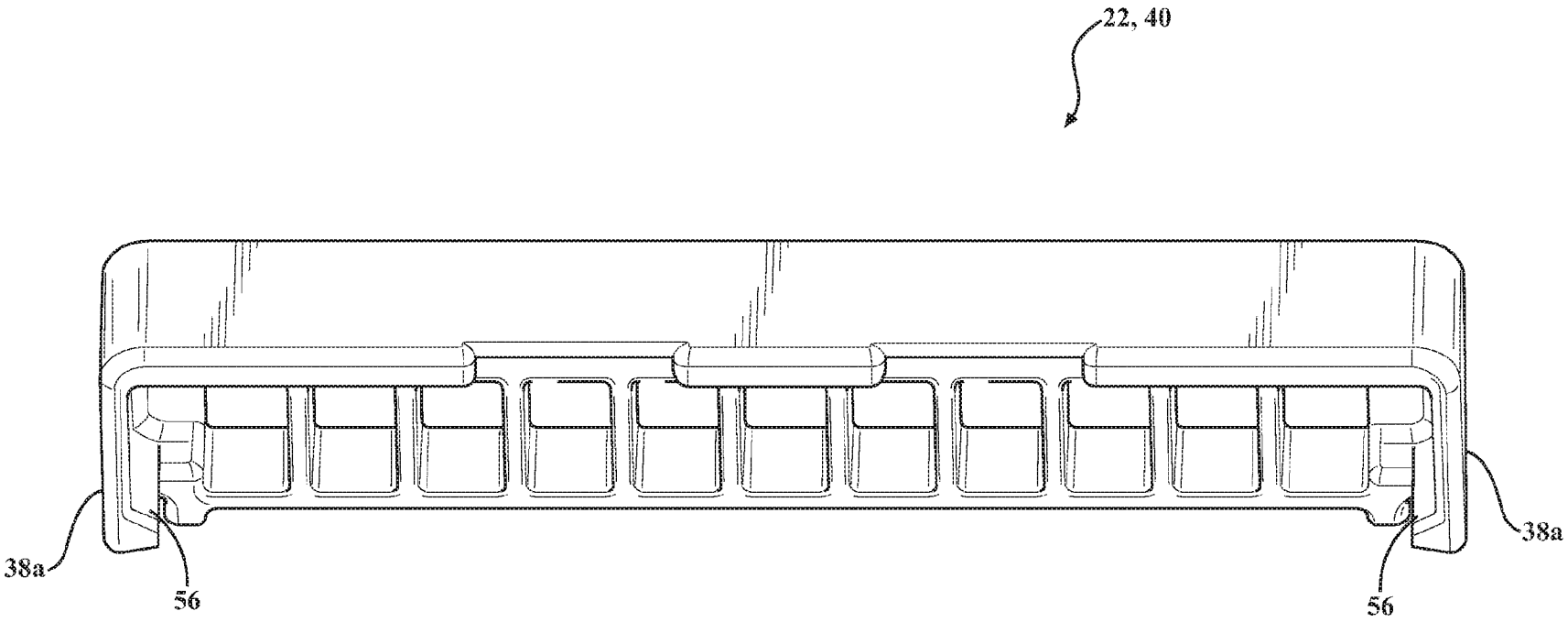
FIG. 5 is an isolated view of a TPA.

FIG. 5 provides an illustrative embodiment of a male or female TPA 22, 40 for use herein. FIG. 7 shows the male and female TPAs 22, 40 seated fully within respective first and second slots 20, 38 so as to be placed in the locked condition. The male and female TPAs 22, 40 includes a plurality of apertures for receiving a respective male blade of the male electric connector. The apertures are defined by walls which help place the male blades in proper position for engagement with the female electric connector as the case may be.

Figure 4:
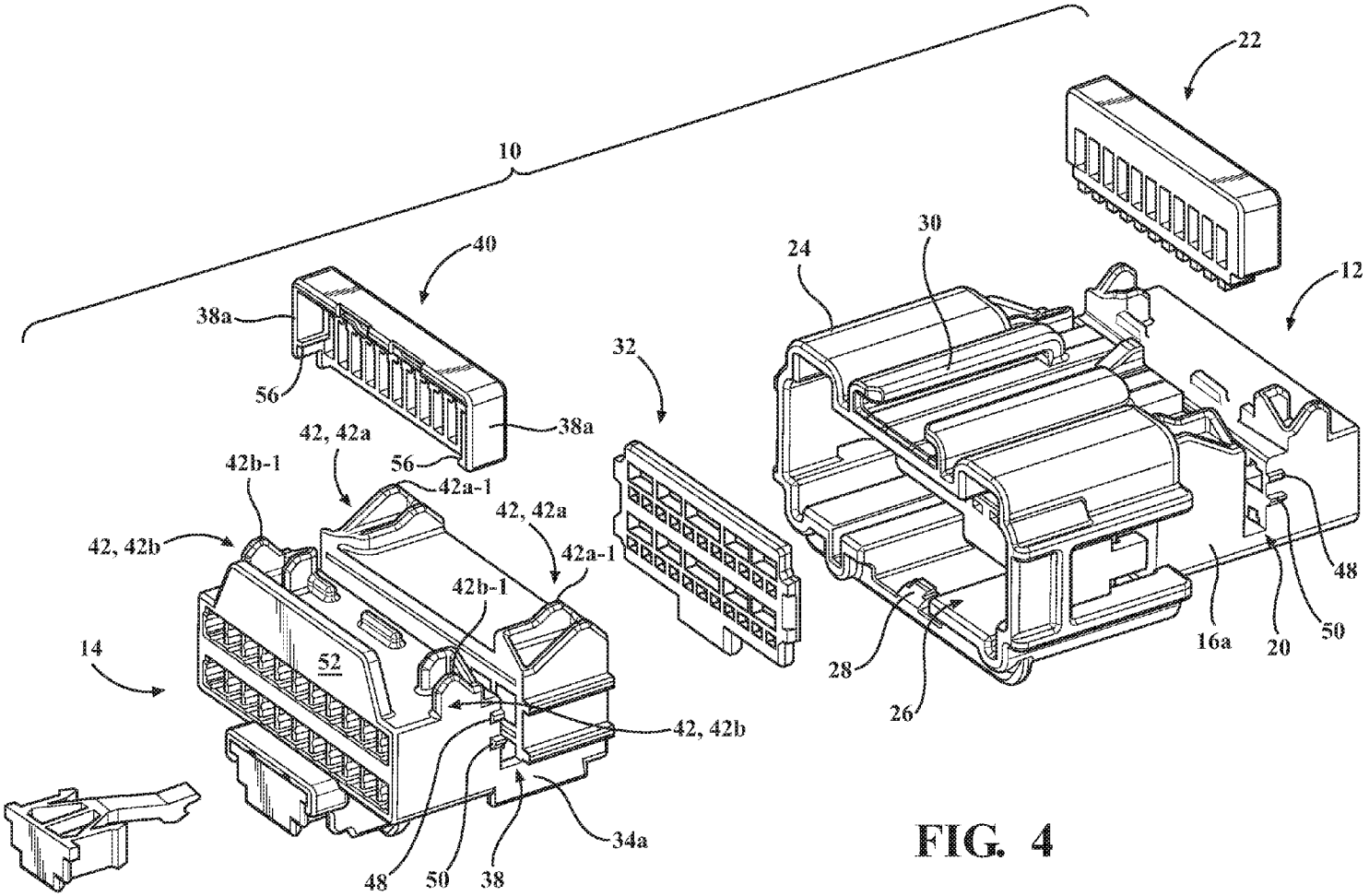
FIG. 4 is an exploded view of the connector housing assembly shown in FIG. 3.

With reference again to FIGS. 2-4, the male housing 12 includes a proximal wall 24 bounding a first open space 26 configured to receive the female housing 14. A first engagement feature 28 may be formed on an inner surface of the proximal wall 24 so as to engage the female housing 14 in a locked engagement. The male housing 12 may include an attachment feature 30 for securing the connector housing assembly 10 to a part (not shown). A male blade stabilizer 32 may be used for insertion within the first open space 26. The male blade stabilizer 32 includes a plurality of apertures and guides for guiding individual male blades of the male connector so as to help position the male blades within a respective female blade of a female electric connector.

The female housing 14 includes a second body 34 having a plurality of second through-bores 36. The second through-bores 36 are configured to receive a respective female electric connector. The second body 34 is generally cuboid and portion of the second body 34 is configured to slide into the first open space 26 and be seated therein. The female housing 14 includes a second slot 38 for receiving a female TPA 40. The second slot 38 extends across the width of the second body 34.

The female housing includes a female TPA support 42 disposed adjacent the second slot 38. The female TPA support 42 is configured to extend a predetermined distance above the female TPA 40 so as to prevent the female TPA 40 from being pushed into the second slot 38 from a top down load. As used herein a top-down load refers to a load placed onto the top surface 40*a* of the female TPA 40. Accordingly, a top-down load may occur from an object falling onto the top surface 40*a* of the female TPA 40, or from the top surface 40*a* of the female TPA 40 hitting an object as the result of a fall.

The male housing 12 includes a hood 44 defining a female TPA passage 46 configured to receive the female TPA support 42 so as to allow the female housing 14 to be seated within the male housing 12. FIG. 7 shows the female TPA support 42 disposed within hood 44 and within the female TPA passage 46.

In one embodiment, the female housing 14 includes a pair of female TPA supports 42*a*. Each of the pair of female TPA supports 42*a* are disposed on opposite sides of the female housing 14 and extend from a proximal edge of the second slot 38 to the proximal end of the second body 34. The female TPA supports 42*a* may be shaped similar to each other as shown in, or may be shaped differently from each other. The top surface 42*a*-1 of each female TPA support 42*a* are spaced above the second body 34 so as to be higher than the female TPA 40 when the female TPA 40 is in the pre-stage condition.

The male and female TPAs 22, 40 are generally shown as being symmetrical to each other. Each of the male and female TPAs 22, 40 are configured to seat within respective first and second slots 20, 38 in a pre-stage and locked condition. FIG. 3 shows the male and female TPAs 22, 40 in the pre-stage condition, wherein the apertures of the male and female TPAs 22, 40 are generally aligned with the first and second through-bores 18, 36 of the male and female housings 12, 14 respectively. Accordingly, the male and female electric connectors may be inserted fully into the first and second through-bores 18, 36 as the case may be.

FIGS. 2 and 7 show the male and female TPAs 22, 40 in the locked position, wherein each of the male and female TPAs 22, 40 are pressed further down into respective first and second slots 20, 38, relative to what is shown in FIG. 3. FIG. 7 shows the blade engagement features 22*a*, 40*a* of the male and female TPAs 22, 40 partially obstructing the first and second through-bores 18, 36. The blade engagement features 22*a*, 40*a* presses downwardly on respective male and female electric connectors so as to facilitate an electric connection.

Each of the male and female housing 12, 14 are configured to engage respective male TPA 22, and female TPA 40 in the pre-stage and locked condition. In one embodiment, each of the male and female housings 12, 14 include a first catch 48 and a second catch 50. The first and second catches 48, 50 are shown disposed on a sidewall 16*a*, 34*b* of respective first and second bodies 16, 34. It should be appreciated that the opposite sidewall of the first and second bodies 16, 34 may also include a first and second catch 48, 50 which are generally the same shape as the first and second catches 48, 50 shown in FIG. 4. The first catch and the second catch 48, 50 may be disposed adjacent the first and second slot 20, 38 as the case may be. The second catch 50 is disposed beneath the first catch 48 so as to form a detent.

A top surface of the first catch 48 is angled so as to facilitate the introduction of the male or female TPA 22, 40 (as the case may be) in the detent. The bottom surface of the first catch 48 is generally planar and orthogonal to the respective sidewall 16*a*, 34*b*. The top surface of the second catch is generally planar and orthogonal to the respective sidewall 16*a*, 34*b*, and a bottom surface of the first and second catch 48, 50 is generally angled so as to facilitate the slide of the male and female TPA 22, 40 (as the case may be) over the second catch 50.

With reference again to FIG. 5, an exemplary depiction of a male and female TPA 22, 40 is shown. The male and female TPAs 22, 38 may be identical to each other and thus an explanation of the operation of the male and female TPAs, 22, 38 will be explained by illustration of the female TPA 38. The female TPA 38 includes a catch feature 56 configured to engage the first catch 48 or the second catch 50 so as to position the female TPA in a pre-stage condition or a locked condition. The female TPA 38 includes a wall 38*a* which bounds the body. In one embodiment, the catch feature 56 is a tab disposed on a bottom portion of a wall 38*a* defining a side of the female TPA 38. It should be appreciated that the female TPA 38 may include a pair of catch features 56 each on opposite sides of the wall 38*a*.

In one embodiment, the male housing 12 includes a pair of hoods 44. Each hood is disposed on opposite sides of the male housing 12. Each hood extends along an axis so as to define a pair of female TPA passages 46 spaced apart from each other and generally parallel to each other. The female TPA passages 46 are configured to allow the female TPA supports 42 to slide into the male housing 12 so as to provide an electrical connection vis-à-vis the mating of the male housing 12 to the female housing 14.

The female housing 14 may be configured to include a plurality of female TPA supports 42. The shape and design of the female TPAs 42 are provided for illustrative purposes only and are not intend to limit the scope of the appended claims. The female TPA support 42 is configured to extend beyond a top surface of the female TPA 38 when the female TPA 38 is in a pre-stage condition. Accordingly, the female TPA support 42 helps ensure that all of the female housings 12 are presented to the installer with the female TPA 38 in the pre-stage condition so as to facilitate the assembly of the connector housing assembly 10.

In one embodiment, the female housing 14 includes a pair of proximal female TPA supports 42*a* and a pair of distal female TPA supports 42*b*. The pair of proximal female TPA supports 42*a* are disposed on a proximal side of the second slot 38 and on opposite sides of the second body 34. The pair of distal female TPA supports 42*b* are disposed on a distal side of the second slot 38 and opposite a respective proximal female TPA support 42*a*. In such an embodiment, all four corners of the female TPA 40 are shield from a top down load when the female TPA 40 is in the pre-stage condition. In particular, the top surface 42*a*-1, 42*b*-1 of respective proximal female TPA supports 42*a* and distal female TPA supports 42*b* extend beyond the top surface of the female TPA 40 when the female TPA 40 is in the pre-stage condition.

The connector housing assembly 10 may further include a lip 52 disposed on a proximal end of the female housing 14. The lip 52 is a generally planar member that extends above a top surface 14*a* of the female housing 14. The lip 52 may be formed taller than the female TPA support 42. The lip 52 is generally orthogonal to the top surface 14*a* of the female housing 14.

Figure 6:
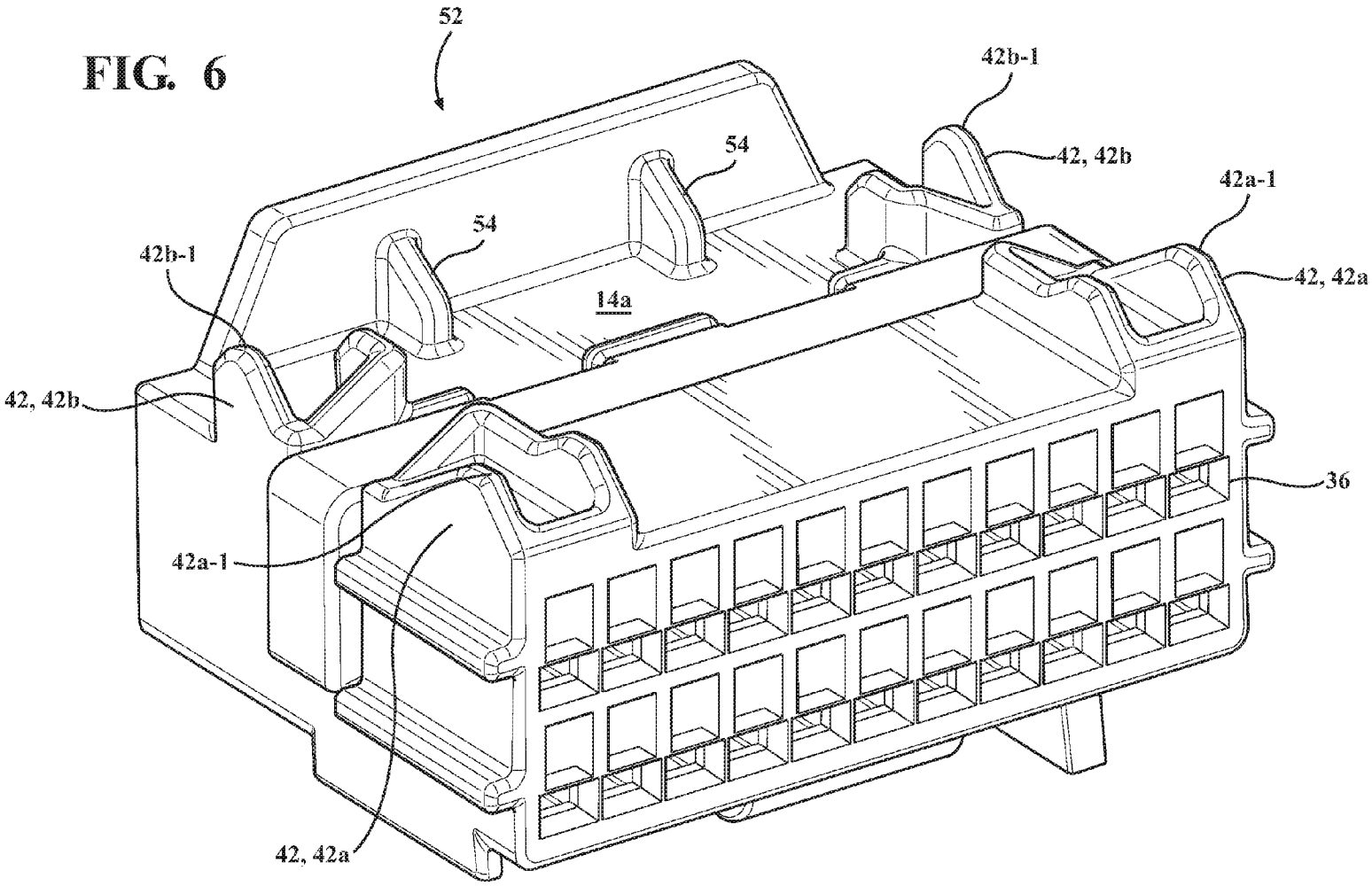
FIG. 6 is an isolated view of a female housing according to one or more embodiments of perspective view of the male terminal positioning assurance shown in FIG. 5 taken from the front.

With reference now to FIG. 6, the connector housing assembly 10 may further including a lip support 54. the lip support 54 may be mounted to the top surface 14*a* of the female housing and behind the front face of the lip 52 so as to support a front load applied to the lip 52. This may be a very useful feature when pushing the female housing 14 into the male housing 12 after the male and female electric connectors are inserted and the male and female TPAs 22, 40 are pushed into the locked condition. In such a condition, wires will protrude from the ends of the male and female housing 12, 14 and it is not desirable to push the female housing 14 by the wires as such an action may damage the wires. Accordingly, the lip 52 provides a surface for pushing the female housing 14 into the male housing 12.

In one embodiment, the connector housing assembly 10 includes a pair of lip supports 54. Each of the pair of lip supports 54 are spaced apart from each other. Each of the pair of lip supports 54 is mounted to the top surface 14*a* of the female housing 14 forward of the second slot 38 and behind the lip 52 so as to support a front load applied to the lip 52.

In operation, a plurality of male housings 12 and a female housing 12 may be shipped in separate packages to a manufacturing site. The male housings 12 and female housings 12 are shipped with respective male and female TPAs 22, 40. The male and female TPAs are disposed in respective first and second slots 20, 38 and in the pre-stage condition. The female TPA support 42 helps prevent the female TPA from being engaged in the locked condition from a top down load during shipment and handling. Accordingly, the female TPA is in position to allow the installer to insert the female electric connectors into the female housing.

The installer removes a male and female housing 12, 14 from the respective package and inserts a corresponding male and female electric connector in the respective housing. The male and female TPAs are then pushed into the locked condition, wherein the blade engagement features 28 press down and position respective male and female electric connectors into a position to engage each other.

The female housing 14 is then inserted into the male housing 12. As there are wires protruding from the back end of the female housing 14, the installer may simply grip the male housing 12 and push the female housing 14 in the male housing 12 by applying a frontal load with a finger or thumb onto the lip 52. The lip 52 may be maintained in a generally upright manner by the lip supports 54.

Accordingly, the connector housing assembly is configured to keep the female TPA in a pre-stage condition so as to facilitate the installation of female electric connectors. Further the lip provides a surface for pushing the female housing into the male housing so as to eliminate the need to grip and push the female housing into the male housing.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A connector housing assembly comprising:

a male housing for housing a male electric connector, the male housing including a first slot for receiving a male TPA;

a female housing for housing a female electric connector, the female housing including a second slot for receiving a female TPA, the female housing is configured to be seated within the male housing so as to connect the male electric connector with the female electric connector; and wherein the female housing includes a female TPA support disposed adjacent the second slot, and extending a predetermined distance above the female TPA so as to prevent the female TPA from being pushed into the second slot from a top down load, and wherein the male housing includes a hood defining a female TPA passage configured to receive the female TPA support so as to allow the female housing to be seated within the male housing.

2. The connector housing assembly of claim 1, wherein the female housing includes a pair of Female TPA supports, each of the pair of female TPA supports disposed on opposite sides of the female housing.

3. The connector housing assembly of claim 2, wherein the male housing includes a pair of hoods, each of the pair of hoods disposed on opposite sides of the male housing, each of the pair of hoods extending along an axis so as to define a pair of female TPA passages spaced apart from each other and generally parallel to each other.

4. The connector housing assembly of claim 1, wherein the female housing includes a pair of proximal female TPA supports and a pair of distal female TPA supports, the pair of proximal female TPA supports are disposed on a proximal side of the second slot and the pair of distal female TPA supports are disposed on a distal side of the second slot.

5. The connector housing assembly of claim 3, wherein the male housing includes a pair of hoods, each of the pair of hoods disposed on opposite sides of the male housing, each of the pair of hoods extending along an axis so as to define a pair of female TPA passages spaced apart from each other and generally parallel to each other.

6. The connector housing assembly of claim 1, wherein the female housing includes a pair of side walls spaced apart from each other, a first catch and a second catch are disposed on one of the pair of side walls adjacent the second slot, wherein the second catch is disposed beneath the first catch.

7. The connector housing assembly of claim 6, wherein the female TPA includes a catch feature configured to engage the first catch or the second catch so as to position the female TPA in a pre-stage condition or a locked condition.

8. The connector housing assembly of claim 7, wherein the catch feature is a tab disposed on a bottom portion of a sidewall of the female TPA.

9. The connector housing assembly of claim 1, further including a lip disposed on a proximal end of the female housing, the lip extending above a top surface of the female housing.

10. The connector housing assembly of claim 9, wherein the lip includes a generally planar surface.

11. The connector housing assembly of claim 10, wherein the lip is taller than the female TPA support.

12. The connector housing assembly of claim 10, wherein the lip is generally orthogonal to the top surface of the female housing.

13. The connector housing assembly as set form in claim 12, further including a lip support, the lip support mounted to the top surface and the lip so as to support a front load applied to the lip.

14. The connector housing assembly of claim 12, further including a pair of lip supports spaced apart from each other, each of the pair of lip supports mounted to the top surface and the lip so as to support a front load applied to the lip.

* * * * *